US009153186B2

(12) United States Patent
Al-Dahle

(10) Patent No.: US 9,153,186 B2
(45) Date of Patent: Oct. 6, 2015

(54) DEVICES AND METHODS FOR KICKBACK-OFFSET DISPLAY TURN-OFF

(75) Inventor: Ahmad Al-Dahle, Santa Clara, CA (US)

(73) Assignee: APPLE INC., Cupertino, CA (US)

( * ) Notice: Subject to any disclaimer, the term of this patent is extended or adjusted under 35 U.S.C. 154(b) by 1041 days.

(21) Appl. No.: 13/249,807

(22) Filed: Sep. 30, 2011

(65) Prior Publication Data

US 2013/0082994 A1 Apr. 4, 2013

(51) Int. Cl.
*G09G 3/36* (2006.01)

(52) U.S. Cl.
CPC ..... *G09G 3/3648* (2013.01); *G09G 2320/0247* (2013.01); *G09G 2330/027* (2013.01)

(58) Field of Classification Search
CPC ..... G09G 2330/027; G09G 2320/0219; G09G 3/3648; G09G 2320/0247; G09G 3/3655; G09G 3/3696; G09G 3/3614; G09G 2320/0223; G09G 3/3677; G09G 2320/0257; G09G 2300/0426; G09G 2300/0876
USPC ..... 345/87–104, 204–214, 690–699
See application file for complete search history.

(56) References Cited

U.S. PATENT DOCUMENTS 5,798,740 A * 8/1998 Bitzakidis et al. ..... 345/92
5,841,411 A * 11/1998 Francis ..... 345/58
7,834,837 B2 11/2010 Syu et al.
8,730,229 B2 * 5/2014 Al-Dahle ..... 345/212
2004/0169629 A1 * 9/2004 Lee et al. ..... 345/95
2007/0024560 A1 * 2/2007 Kim et al. ..... 345/94
2007/0115274 A1 * 5/2007 Shih ..... 345/211
2007/0211006 A1 * 9/2007 Lee et al. ..... 345/89
2008/0198122 A1 8/2008 Shin et al.
2008/0224983 A1 9/2008 Lee et al.
2008/0238853 A1 * 10/2008 Tu et al. ..... 345/98
2009/0167659 A1 7/2009 Kim et al.
2011/0210958 A1 * 9/2011 Yoo et al. ..... 345/214
2011/0227955 A1 * 9/2011 Lee et al. ..... 345/690
2012/0092312 A1 * 4/2012 Xue et al. ..... 345/205
2012/0242641 A1 * 9/2012 Lee et al. ..... 345/212
2013/0076721 A1 * 3/2013 Al-Dahle ..... 345/212
2013/0271677 A1 * 10/2013 Koo ..... 349/33

* cited by examiner

*Primary Examiner* — Dmitriy Bolotin
(74) *Attorney, Agent, or Firm* — Fletcher Yoder PC

(57) ABSTRACT

Methods and devices employing circuitry for display turn-off that offsets the effect of kickback voltage are provided. In one example, a method may include determining an amount of kickback voltage that is expected to occur in pixels of the electronic display during shutdown of the display, supplying a common voltage output to a common electrode of a pixel of the electronic display, and supplying an activation signal to the pixel to activate the pixel. The method may also include supplying a data signal to a pixel electrode of the pixel. The data signal may be substantially equal to the sum of the common voltage output and the determined kickback voltage. The method may include removing the activation signal from the pixel to store the data signal in the pixel to reduce the effect of kickback voltage on the pixel electrode of the pixel during shutdown of the electronic display.

21 Claims, 6 Drawing Sheets

DEVICES AND METHODS FOR KICKBACK-OFFSET DISPLAY TURN-OFF

BACKGROUND

The present disclosure relates generally to electronic displays and, more particularly, to liquid crystal displays (LCDs) that can be turned off in a manner that offsets the otherwise undesirable effects of kickback voltage on LCD pixels.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Electronic displays, such as liquid crystal displays (LCDs), are commonly used in electronic devices such as televisions, computers, and phones. LCDs portray images by modulating the amount of light that passes through a liquid crystal layer within pixels of varying color. For example, by varying a voltage difference between a pixel electrode and a common electrode in a pixel, an electric field may result. The electric field may cause the liquid crystal layer to vary its alignment, which may ultimately result in more or less light being emitted through the pixel where it may be seen. By changing the voltage difference (often referred to as a data signal) supplied to each pixel, images may be produced on the LCD.

To store data representing a particular amount of light that is to be passed through pixels, gates of thin-film transistors (TFTs) in the pixels may be activated while the data signal is supplied to the pixels. Conventionally, when an LCD is turned off, the pixel electrodes of all pixels of the LCD may be supplied a minimal voltage. When the TFT gates are deactivated, a kickback voltage may alter the voltage stored in the pixels. The resulting voltage may be different from the supplied minimal voltage and may cause an electric field that remains in place after the LCD is turned off. This electric field may continue to impact the liquid crystal layer of the pixels of the LCD while the LCD is off. It is believed that this electric field caused by the voltage on the pixel electrodes may result in image artifacts, such as flickering, that could appear after the display is turned on again.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

Embodiments of the present disclosure relate to devices and methods for turning off an electronic display to reduce the effect of a kickback voltage when the display is turned off. By way of example, a method for reducing the effect of kickback voltage when turning off an electronic display may include determining an amount of kickback voltage that is expected to occur in pixels of the electronic display during shutdown of the display, supplying a common voltage output to a common electrode of a pixel of the electronic display, and supplying an activation signal to the pixel to activate the pixel. The method may also include supplying a data signal to a pixel electrode of the pixel. The data signal may be substantially equal to the sum of the common voltage output supplied to the common electrode and the determined kickback voltage. The method may include removing the activation signal from the pixel while the data signal is being supplied to the pixel to store the data signal in the pixel to reduce the effect of kickback voltage on the pixel electrode of the pixel during shutdown of the electronic display.

Various refinements of the features noted above may be made in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

Figure 1:
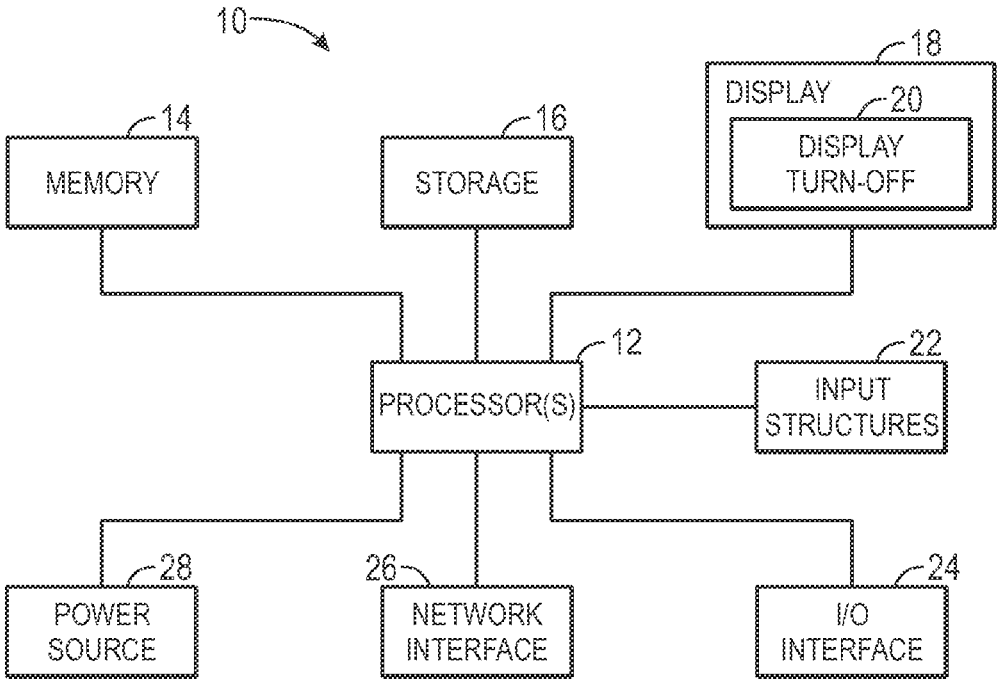
FIG. 1 is a schematic block diagram of an electronic device with a liquid crystal display (LCD) having circuitry for display turn-off that offsets the effect of kickback voltage, in accordance with an embodiment.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As mentioned above, embodiments of the present disclosure relate to liquid crystal displays (LCDs) and electronic devices incorporating LCDs that employ a display shut-down device, method, or combination thereof. Specifically, rather than turning off an electronic display in a conventional manner, which could result in a residual voltage remaining on the pixels of the electronic display, which could in turn cause image artifacts when the display is turned back on, embodiments of the present disclosure may incorporate circuitry for display turn-off that offsets the effect of kickback voltage.

Specifically, to decrease the amount of residual voltage remaining on the pixels, an amount of kickback voltage that is expected to occur in pixels of the electronic display during shutdown is determined. A common voltage output may be supplied to a common electrode of a pixel of the electronic display. An activation signal may be supplied to the pixel to activate the pixel. A data signal that is substantially equal to the sum of the common voltage output and the determined kickback voltage may be supplied to the pixel electrode of the pixel and the activation signal may be removed from the pixel while the data signal is being supplied to the pixel to store the data signal in the pixel. It is believed that when the activation signal is removed from the pixel, the data signal in the pixel may change by a kickback voltage, thereby causing the data signal in the pixel to be approximately the common voltage output. As a result, it is believed that a residual voltage may be less likely to appear on the liquid crystal after the LCD is turned off and, accordingly, image artifacts may be less likely to occur when the LCD is turned back on.

Figure 2:
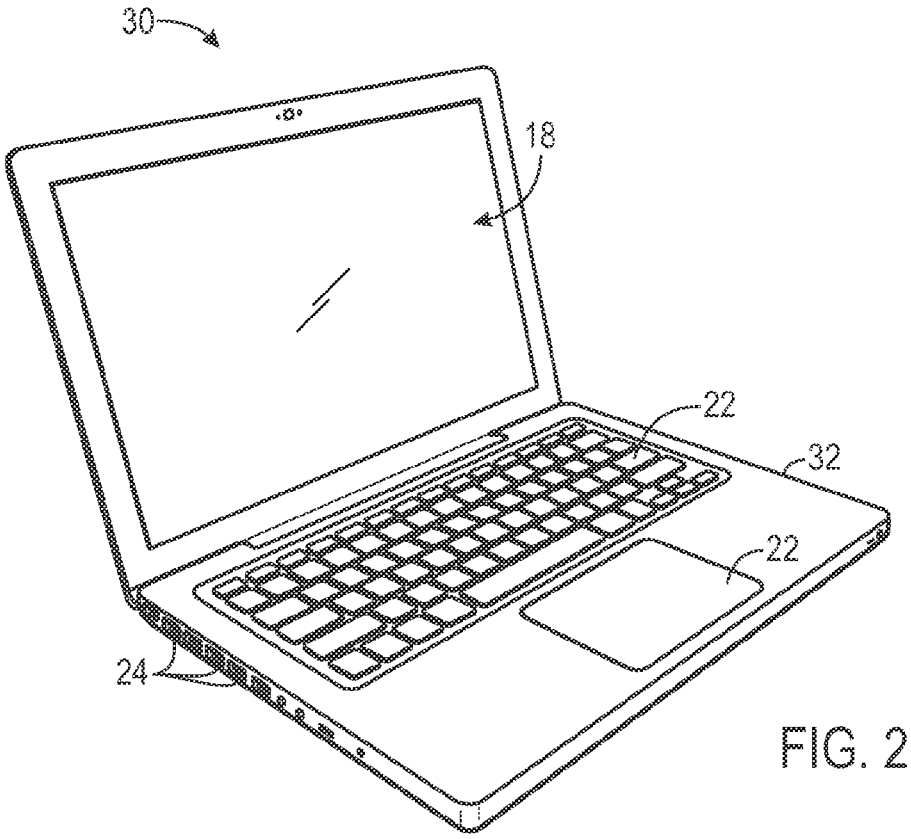
FIG. 2 is a perspective view of a notebook computer representing an embodiment of the electronic device of FIG. 1.
Figure 3:
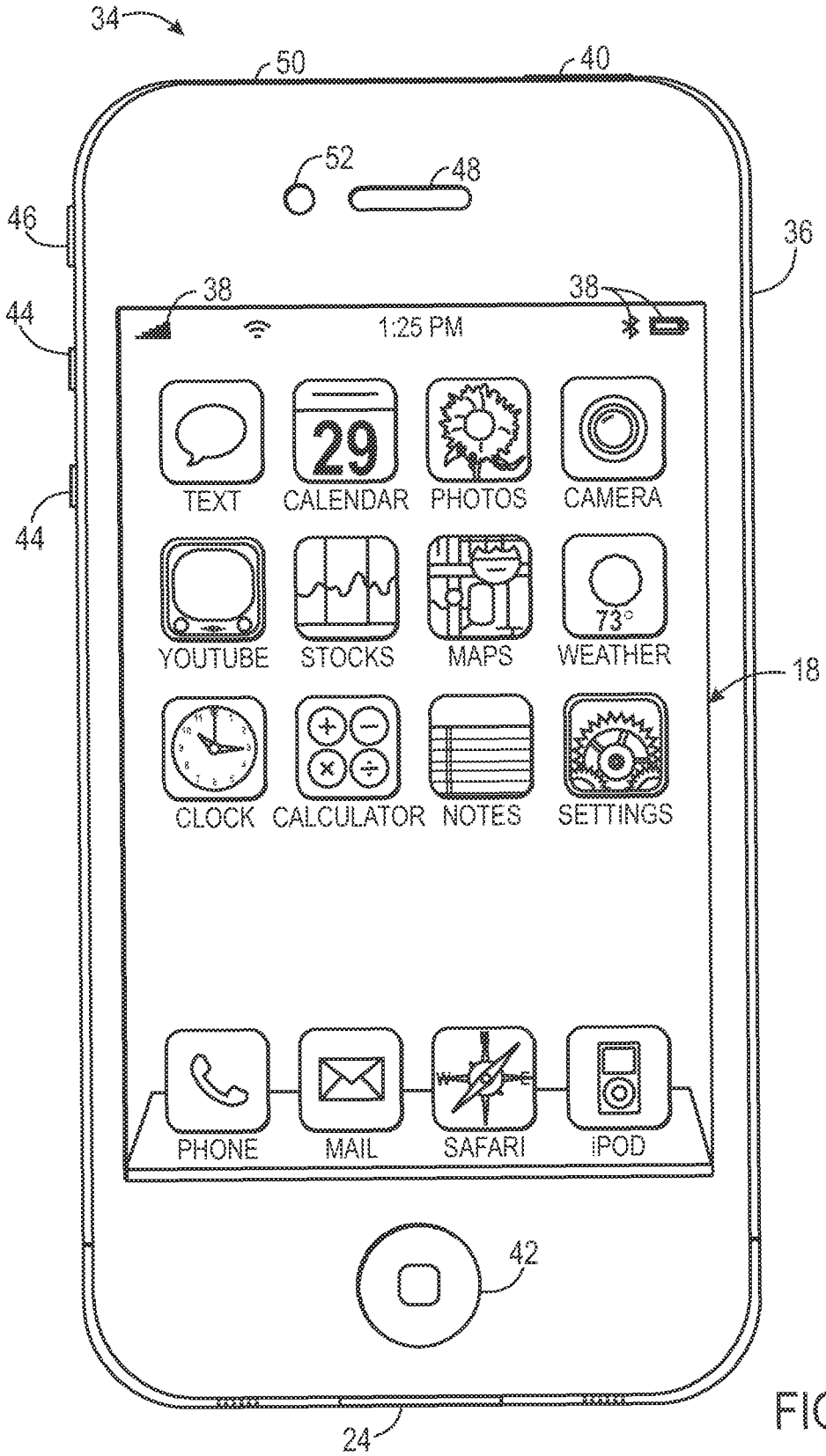
FIG. 3 is a front view of a handheld device representing another embodiment of the electronic device of FIG. 1.

With the foregoing in mind, a general description of suitable electronic devices that may employ electronic displays having capabilities to turn off a display using a determined kickback voltage will be provided below. In particular, FIG. 1 is a block diagram depicting various components that may be present in an electronic device suitable for use with such a display. FIGS. 2 and 3 respectively illustrate perspective and front views of a suitable electronic device, which may be, as illustrated, a notebook computer or a handheld electronic device.

Turning first to FIG. 1, an electronic device 10 according to an embodiment of the present disclosure may include, among other things, one or more processor(s) 12, memory 14, nonvolatile storage 16, a display 18 having display control circuitry 20 for display turn-off that offsets the effect of kickback voltage, input structures 22, an input/output (I/O) interface 24, network interfaces 26, and a power source 28. The various functional blocks shown in FIG. 1 may include hardware elements (including circuitry), software elements (including computer code stored on a computer-readable medium) or a combination of both hardware and software elements. It should be noted that FIG. 1 is merely one example of a particular implementation and is intended to illustrate the types of components that may be present in the electronic device 10.

By way of example, the electronic device 10 may represent a block diagram of the notebook computer depicted in FIG. 2, the handheld device depicted in FIG. 3, or similar devices. It should be noted that the processor(s) 12 and/or other data processing circuitry may be generally referred to herein as "data processing circuitry." This data processing circuitry may be embodied wholly or in part as software, firmware, hardware, or any combination thereof. Furthermore, the data processing circuitry may be a single contained processing module or may be incorporated wholly or partially within any of the other elements within the electronic device 10. As presented herein, the data processing circuitry may control the electronic display 18 by determining when the electronic display 18 is to be turned off and by issuing a turn-off or shutdown command. The turn-off or shutdown command is provided to the display 18, which uses the display control circuitry 20 to turn off the display 18 in a way that reduces the occurrence of image artifacts when the display 18 is later turned back on.

In the electronic device 10 of FIG. 1, the processor(s) 12 and/or other data processing circuitry may be operably coupled with the memory 14 and the nonvolatile memory 16 to execute instructions. Such programs or instructions executed by the processor(s) 12 may be stored in any suitable article of manufacture that includes one or more tangible, computer-readable media at least collectively storing the instructions or routines, such as the memory 14 and the nonvolatile storage 16. The memory 14 and the nonvolatile storage 16 may include any suitable articles of manufacture for storing data and executable instructions, such as random-access memory, read-only memory, rewritable flash memory, hard drives, and optical discs. Also, programs (e.g., an operating system) encoded on such a computer program product may also include instructions that may be executed by the processor(s) 12.

The display 18 may be a touch-screen liquid crystal display (LCD), for example, which may enable users to interact with a user interface of the electronic device 10. In some embodiments, the electronic display 18 may be a MultiTouch™ display that can detect multiple touches at once. As will be described further below, the display control circuitry 20 may include circuitry that can determine an amount of kickback voltage that is expected to occur in pixels of the electronic display 18 during shutdown of the display 18. This value of kickback voltage can then be used to offset the effect of kickback voltage on pixels of the display 18 when the display 18 is turned off.

The input structures 22 of the electronic device 10 may enable a user to interact with the electronic device 10 (e.g., pressing a button to increase or decrease a volume level). The I/O interface 24 may enable electronic device 10 to interface with various other electronic devices, as may the network interfaces 26. The network interfaces 26 may include, for example, interfaces for a personal area network (PAN), such as a Bluetooth network, for a local area network (LAN), such as an 802.11x Wi-Fi network, and/or for a wide area network (WAN), such as a 3G or 4G cellular network. The power source 28 of the electronic device 10 may be any suitable source of power, such as a rechargeable lithium polymer (Li-poly) battery and/or an alternating current (AC) power converter.

The electronic device 10 may take the form of a computer or other type of electronic device. Such computers may include computers that are generally portable (such as laptop, notebook, and tablet computers) as well as computers that are generally used in one place (such as conventional desktop computers, workstations and/or servers). In certain embodiments, the electronic device 10 in the form of a computer may be a model of a MacBook®, MacBook® Pro, MacBook Air®, iMac®, Mac® mini, or Mac Pro® available from Apple Inc. By way of example, the electronic device 10, taking the form of a notebook computer 30, is illustrated in FIG. 2 in accordance with one embodiment of the present disclosure. The depicted computer 30 may include a housing 32, a display 18, input structures 22, and ports of an I/O interface 24. In one embodiment, the input structures 22 (such as a keyboard and/or touchpad) may be used to interact with the computer 30, such as to start, control, or operate a GUI or applications running on computer 30. For example, a keyboard and/or touchpad may allow a user to navigate a user interface or application interface displayed on the display 18. Further, the display 18 may include the display control circuitry 20 for display turn-off that offsets the effect of kickback voltage.

FIG. 3 depicts a front view of a handheld device 34, which represents one embodiment of the electronic device 10. The handheld device 34 may represent, for example, a portable phone, a media player, a personal data organizer, a handheld game platform, or any combination of such devices. By way of example, the handheld device 34 may be a model of an iPod® or iPhone® available from Apple Inc. of Cupertino, Calif. In other embodiments, the handheld device 34 may be a tablet-sized embodiment of the electronic device 10, which may be, for example, a model of an iPad® available from Apple Inc.

The handheld device 34 may include an enclosure 36 to protect interior components from physical damage and to shield them from electromagnetic interference. The enclosure 36 may surround the display 18, which may display indicator icons 38. The indicator icons 38 may indicate, among other things, a cellular signal strength, Bluetooth connection, and/or battery life. The I/O interfaces 24 may open through the enclosure 36 and may include, for example, a proprietary I/O port from Apple Inc. to connect to external devices.

User input structures 40, 42, 44, and 46, in combination with the display 18, may allow a user to control the handheld device 34. For example, the input structure 40 may activate or deactivate the handheld device 34, the input structure 42 may navigate a user interface to a home screen, a user-configurable application screen, and/or activate a voice-recognition feature of the handheld device 34, the input structures 44 may provide volume control, and the input structure 46 may toggle between vibrate and ring modes. A microphone 48 may obtain a user's voice for various voice-related features, and a speaker 50 may enable audio playback and/or certain phone capabilities. A headphone input 52 may provide a connection to external speakers and/or headphones. As mentioned above, the display 18 may include the display control circuitry 20 for display turn-off that offsets the effect of kickback voltage.

Figure 4:
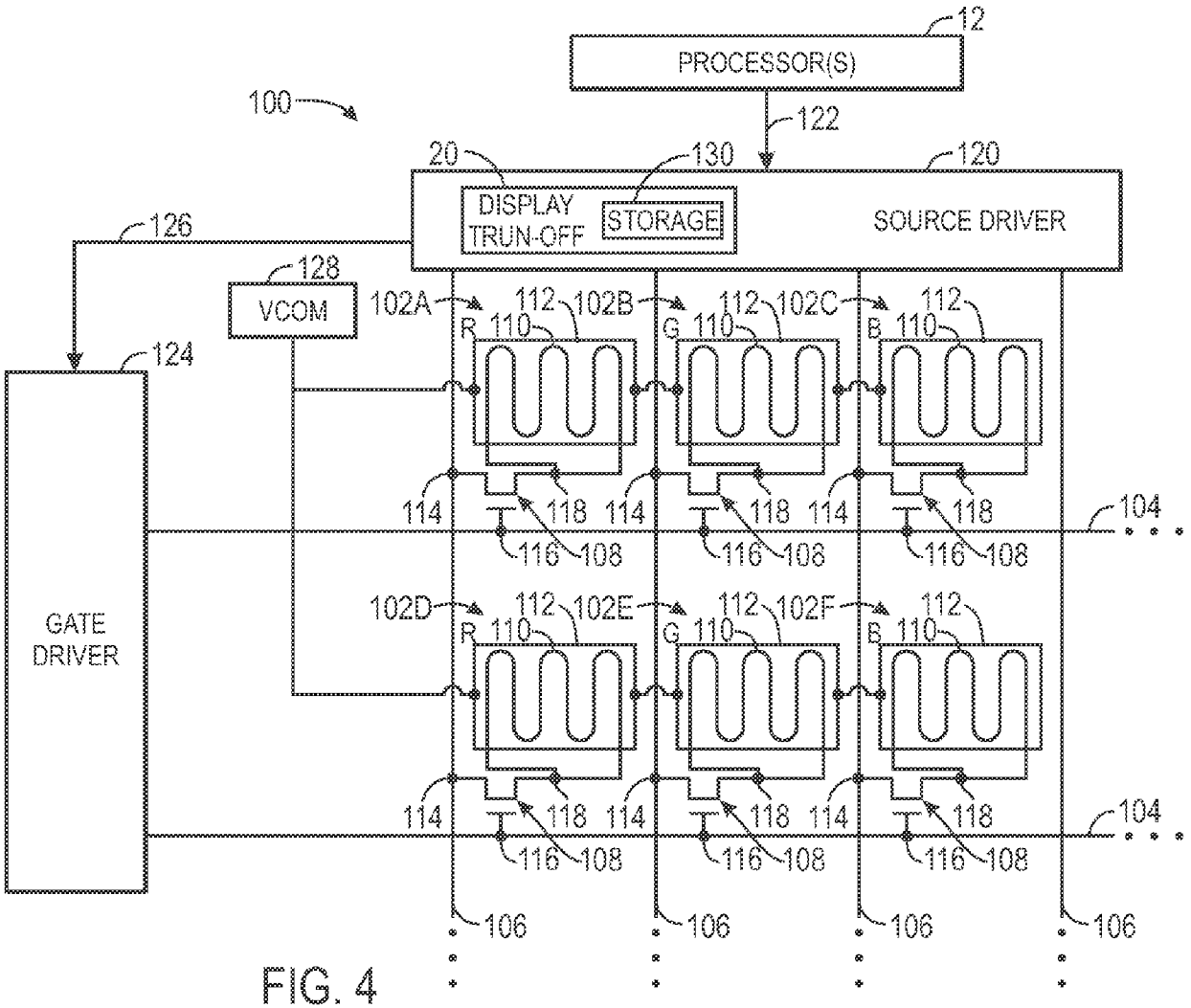
FIG. 4 is a circuit diagram illustrating display circuitry used to turn off pixels of an LCD with reduced effect from kickback voltage, in accordance with an embodiment.

Among the various components of an electronic display 18 may be a pixel array 100, as shown in FIG. 4. FIG. 4 generally represents a circuit diagram of certain components of the display 18 in accordance with an embodiment. In particular, the pixel array 100 of the display 18 may include a number of unit pixels 102 disposed in a pixel array or matrix. In such an array, each unit pixel 102 may be defined by the intersection of rows and columns, represented by gate lines 104 (also referred to as scanning lines), and source lines 106 (also referred to as data lines), respectively. Although only six unit pixels 102, referred to individually by the reference numbers 102A-102F, respectively, are shown for purposes of simplicity, it should be understood that in an actual implementation, each source line 106 and gate line 104 may include hundreds or thousands of such unit pixels 102. Each of the unit pixels 102 may represent one of three subpixels that respectively filters only one color (e.g., red, blue, or green) of light. For purposes of the present disclosure, the terms "pixel," "subpixel," and "unit pixel" may be used largely interchangeably.

In the presently illustrated embodiment, each unit pixel 102 includes a thin film transistor (TFT) 108 for switching a data signal supplied to a respective pixel electrode 110. The potential stored on the pixel electrode 110 relative to a potential of a common electrode 112, which may be shared by other pixels 102, may generate an electrical field sufficient to alter the arrangement of a liquid crystal layer of the display 18. In the depicted embodiment of FIG. 4, a source 114 of each TFT 108 may be electrically connected to a source line 106 and a gate 116 of each TFT 108 may be electrically connected to a gate line 104. A drain 118 of each TFT 108 may be electrically connected to a respective pixel electrode 110. Each TFT 108 may serve as a switching element that may be activated and deactivated (e.g., turned on and off) for a period of time based on the respective presence or absence of a scanning or activation signal on the gate lines 104 that are applied to the gates 116 of the TFTs 108.

When activated, a TFT 108 may store the image signals received via the respective source line 106 as a charge upon its corresponding pixel electrode 110. As noted above, the image signals stored by the pixel electrode 110 may be used to generate an electrical field between the respective pixel electrode 110 and a common electrode 112. This electrical field may align the liquid crystal molecules within the liquid crystal layer to modulate light transmission through the pixel 102. Thus, as the electrical field changes, the amount of light passing through the pixel 102 may increase or decrease. In general, light may pass through the unit pixel 102 at an intensity corresponding to the applied voltage from the source line 106.

The display 18 also may include a source driver integrated circuit (IC) 120, which may include a chip, such as a processor, microcontroller, or application specific integrated circuit (ASIC), that controls the display pixel array 100 by receiving image data 122 from the processor(s) 12 and sending corresponding image signals to the unit pixels 102 of the pixel array 100. It should be understood that the source driver 120 may be a chip-on-glass (COG) component on a TFT glass substrate, a component of a display flexible printed circuit (FPC), and/or a component of a printed circuit board (PCB) that is connected to the TFT glass substrate via the display FPC. Further, the source driver 120 may include any suitable article of manufacture having one or more tangible, computer-readable media for storing instructions that may be executed by the source driver 120. In addition, the source driver 120 may include the display control circuitry 20.

The source driver 120 also may couple to a gate driver integrated circuit (IC) 124 that may activate or deactivate rows of unit pixels 102 via the gate lines 104. As such, the source driver 120 may provide timing signals 126 to the gate driver 124 to facilitate the activation/deactivation of individual rows (i.e., lines) of pixels 102. In other embodiments, timing information may be provided to the gate driver 124 in some other manner. The display 18 may include a Vcom source 128 to provide a Vcom output to the common electrodes 112. In some embodiments, the Vcom source 128 may supply a different Vcom to different common electrodes 112 at different times. In other embodiments, the common electrodes 112 all may be maintained at the same potential (e.g., a ground potential) while the display 18 is on.

During operation, a kickback voltage may occur when an activation signal is removed by the gate driver 124. That is, when the activation signal is removed, the voltage stored by the pixel electrode 110 may change by an amount substantially equal to the kickback voltage. When the display 18 is turned off, a very low voltage or ground potential may be applied to the pixel electrodes 110. Doing so may minimize the voltage difference biasing the liquid crystal between the pixel electrodes 110 and the common electrodes 112. If a kickback voltage occurs as the display 18 is being shut off, the originally applied voltage could change by the kickback voltage amount, leaving a non-zero bias voltage on the pixel electrodes 110. It is believed that this bias voltage caused by the kickback voltage could affect the liquid crystal, creating image artifacts on the display 18 for a long time (e.g., several minutes) after the display 18 is turned back on.

Accordingly, the display control circuitry 20 of the display 18 for display turn-off that offsets the effect of kickback voltage may inhibit image artifacts from appearing on the display 18, such as when the display 18 is turned on after previously being turned off. Specifically, the display control circuitry 20 may determine an amount of kickback voltage that is expected to occur in pixels 102 of the display 18 during shutdown of the display 18. Further, the display control circuitry 20 may store the determined amount of kickback voltage in a storage device 130. As may be appreciated, the storage device 130 may be any suitable article of manufacture having a tangible, computer-readable media for storing the determined amount of kickback voltage. For example, the storage device 130 may be an EEPROM device.

The display control circuitry 20 may also cause the data signal applied to the source lines 106 to be substantially equal to the sum of the Vcom output being supplied to the common electrodes 112 and the determined kickback voltage. Therefore, when a kickback voltage occurs, the voltage remaining on the pixel electrodes 110 will be substantially equal to the Vcom output being supplied to the common electrodes 112. Specifically, the voltage remaining on the pixel electrodes 110 will be the applied sum of the Vcom output and the determined kickback voltage, minus the actual kickback voltage. Consequently, if the determined kickback voltage is similar to the actual kickback voltage, the determined and actual kickback voltages will effectively cancel each other out leaving the Vcom output remaining on the pixel electrodes 110. As a result, the bias voltage on the pixel electrodes 110 when the display 18 is turned off may be low, or near zero.

As may be appreciated, there may be a variety of ways that the display control circuitry 20 may determine an amount of kickback voltage that is expected to occur in pixels 102 of the display 18 during shutdown of the display 18. For example, the display control circuitry 20 may determine the amount of kickback voltage that is expected to occur in pixels 102 by measuring a kickback voltage that occurs on a dummy pixel, as described below in relation to FIG. 8. In another example, the display control circuitry 20 may determine the amount of kickback voltage that is expected to occur in pixels 102 by varying the Vcom output of the display 18 until screen artifacts are reduced, as described below in relation to FIG. 9.

Figure 5:
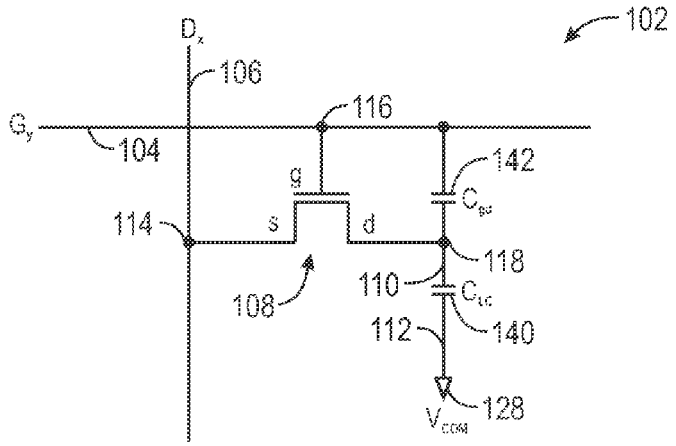
FIG. 5 is a circuit diagram of a pixel of an LCD, in accordance with an embodiment.

Within the pixel array 100, each pixel 102 stores data on the pixel electrodes 110 of the pixel. In the illustrated embodiment of FIG. 5, the pixel 102 includes the TFT 108 as previously described. The source 114 of the TFT 108 is electrically connected to the source line ($D_x$) 106 and the gate 116 of the TFT 108 is electrically connected to the gate line ($G_y$) 104. Further, the drain 118 of the TFT 108 is electrically connected to the pixel electrode 110. The Vcom source 128 is electrically connected to the common electrode 112. A liquid crystal capacitance ($C_{LC}$) 140 may be present between the pixel electrode 110 and the common electrode 112 and a parasitic capacitance ($C_{gd}$) 142 may be present between the gate 116 and the drain 118 of the TFT 108.

During operation, a Vcom output is supplied by the Vcom source 128. An activation signal is supplied to the gate line ($G_y$) 104 to activate the gate 116 of the TFT 108. In addition, a data signal is supplied to the source line ($D_x$) 106 and, therefore, to the source 114 of the TFT 108. With the TFT 108 activated, the data signal supplied to the source 114 flows through the TFT 108 to the drain 118. Thus, the data signal is supplied to the pixel electrode 110. To store the data signal in the pixel electrode 110, the activation signal is removed from the gate line ($G_y$) 104 while the data signal is still being supplied to the source line ($D_x$) 106. However, when the activation signal is removed, a portion of the voltage stored by the pixel electrode 110 charges the parasitic capacitance ($C_{gd}$) 142, thereby altering the voltage stored by the pixel electrode 110. The amount of voltage change by the pixel electrode 110 after the activation signal is removed is the "kickback voltage." It is believed that this effect is facilitated by the connection of the common electrode 112 to the Vcom source 128 (e.g., the Vcom source 128 may provide a supply of charge to the common electrode 112).

The presently disclosed embodiments may reduce and/or eliminate image artifacts caused by the kickback voltage altering the voltage stored on the pixel electrode 110 when the display 18 is turned off. When the display 18 is to be shut down, a Vcom output (e.g., ground) may be supplied to the common electrode 112. A data signal that is substantially equal to the sum of the Vcom output supplied to the common electrode 112 and a determined kickback voltage may be supplied to the pixel electrode 110 as described above. The TFT 108 is activated, and then the activation signal is removed while the data signal is still being supplied to the pixel electrode 110. When the activation signal is removed, a kickback voltage may cause the voltage on the pixel electrode 110 to change. However, the resulting net voltage across the pixel electrode 110 may be low, or near zero and, therefore, the effect of the kickback voltage may be reduced.

Figure 6:
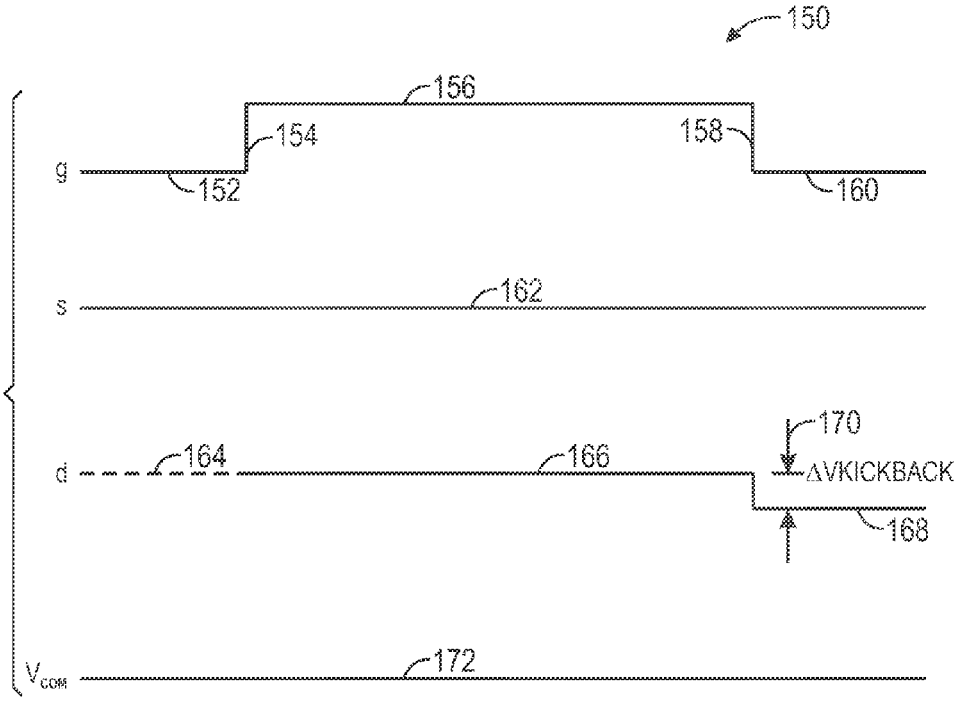
FIG. 6 is a timing diagram illustrating a turn-off sequence to turn off pixels of an LCD with reduced effect from kickback voltage, in accordance with an embodiment.

In some examples, the specific timing of the source signal, activation signal, and Vcom signal being supplied to the pixel 102 during shutdown may be controlled to reduce kickback effects. FIG. 6 illustrates one embodiment of a timing diagram 150 that shows the timing of the signals in the pixel 102 when the display 18 is to be turned off. The signal applied to the gate 116 (i.e., the activation signal) starts in a deactivated state within segment 152. At a time 154, the signal applied to the gate 116 transitions to the activated state throughout segment 156. Then, at a time 158, the signal applied to the gate 116 transitions to the deactivated state for segment 160.

In the illustrated embodiment, a signal (e.g., the sum of a Vcom output and a determined kickback voltage) applied to the source 114 of the TFT 108 remains constant throughout the segment 162. Therefore, the signal applied to the source 114 is the same before the activation signal is supplied and after the activation signal is removed (i.e., before time 154 and after time 158, respectively). It should be noted that the signal applied to the source 114 does not necessarily need to remain at a constant level as illustrated. Specifically, the signal applied to the source 114 should be applied while the activation signal is present (i.e., while the gate 116 of the TFT 108 is activated) for a time period sufficient to cause the signal to be present on the drain 118 of the TFT 108 and to be stored in the pixel electrode 110. Further, the signal applied to the source 114 should continue to be applied until the activation signal is removed.

The signal present at the drain 118 is illustrated with three segments 164, 166, and 168. At segment 164, the signal present at the drain 118 could be set at any level. Then, at time 154 when the activation signal is supplied, the signal present on the drain 118 is set by the signal on the source 114 (i.e., the sum of the Vcom output and the determined kickback voltage) as shown by segment 166. The signal present on the drain 118 remains substantially constant throughout segment 166. When the activation signal is removed at time 158, the signal present on the drain 118 changes as shown by segment 168. It should be noted that the signal present on the drain 118 changes by a kickback voltage 170. Thus, the signal present on the drain 118 during segment 168 is substantially the same as the Vcom output (i.e., the sum of the Vcom output and the determined kickback voltage minus the kickback voltage). Therefore, the effects of the kickback voltage may be reduced.

The Vcom output that is present at the common electrode 112 is illustrated by the line segment 172. The Vcom output remains at a set value throughout segment 172. As may be appreciated, the Vcom output present throughout segment 172 may be any suitable value. For example, in certain embodiments, the Vcom output may be ground.

Figure 7:
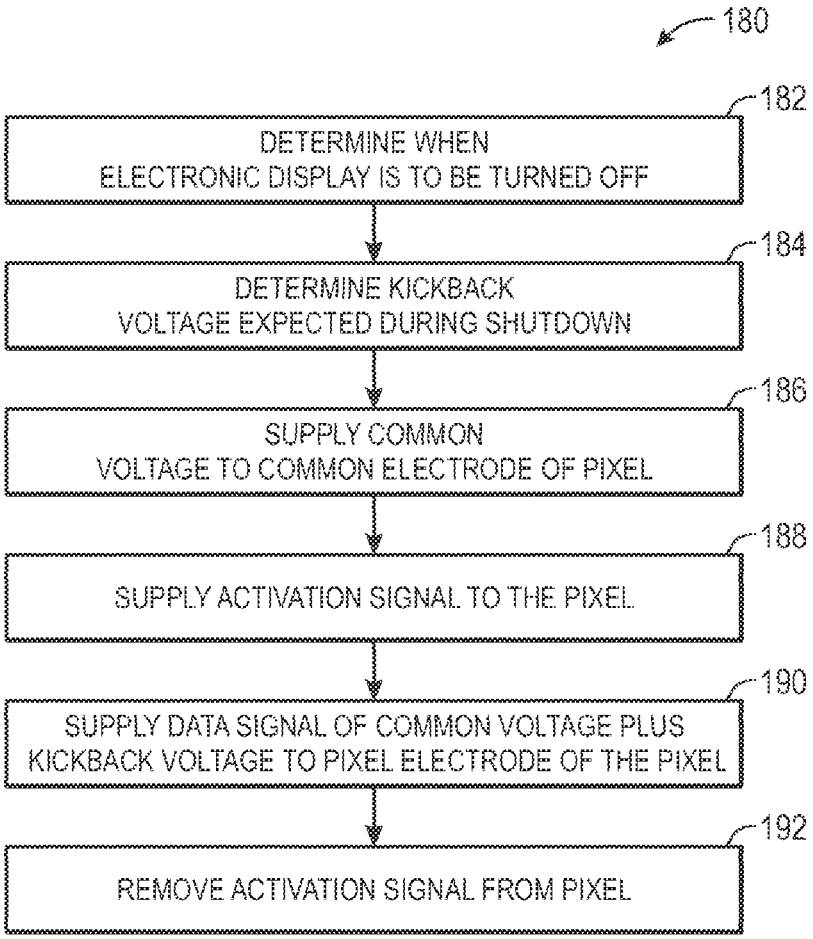
FIG. 7 is a flowchart describing a method for turning off a pixel in an LCD with reduced effect from kickback voltage, in accordance with an embodiment.

As presented, the display 18 is shut down using a series of operations that may inhibit image artifacts from appearing when the display 18 is subsequently turned back on. FIG. 7 illustrates one embodiment of a method 180 for turning off one or more pixels 102 of the display 18. At block 182, data processing circuitry, or other control circuitry, determines when the display 18 is to be turned off. Then, at block 184, data processing circuitry, or other control circuitry (e.g., display control circuitry 20), determines an amount of kickback voltage that is expected to occur in pixels 102 of the electronic display 18 during shutdown of the display 18. At block 186, the Vcom source 128 supplies a Vcom output (e.g., ground) to the common electrode 112 of the pixel 102. As may be appreciated, in some embodiments, the Vcom output supplied to the common electrode 112 is some voltage other than ground.

Next, at block 188, display circuitry, such as the gate driver 124, supplies an activation signal to the pixel 102 to activate the pixel. The activation signal enables a data signal to travel from the source 114 of the TFT 108 to the drain 118 of the TFT 108. At block 190, display circuitry, such as the source driver 120, supplies a data signal (i.e., the sum of the Vcom output and the determined kickback voltage) to the pixel electrode 110 of the pixel 102. In certain embodiments, such as when the Vcom output is zero or ground, the data signal may be substantially equal to the determined kickback voltage. Then, at block 192, display circuitry, such as the gate driver 124, removes the activation signal from the pixel 102 while the data signal is being supplied to the pixel 102 to store the data signal in the pixel 102. When the activation signal is removed from the pixel 102, the data signal at the pixel electrode 110 may change by a kickback voltage. Such a kickback voltage may cause the voltage at the pixel electrode 110 to change by the amount of the determined kickback voltage. For example, the voltage at the pixel electrode 110 may change to be substantially equal to the Vcom output. Although the method 180 is presented in relation to turning off one pixel, similar operations may be implemented for turning off lines of pixels or for turning off a complete display of pixels. In implementing such additional operations, lines of pixels may be turned off separately or concurrently (i.e., substantially the same time).

Figure 8:
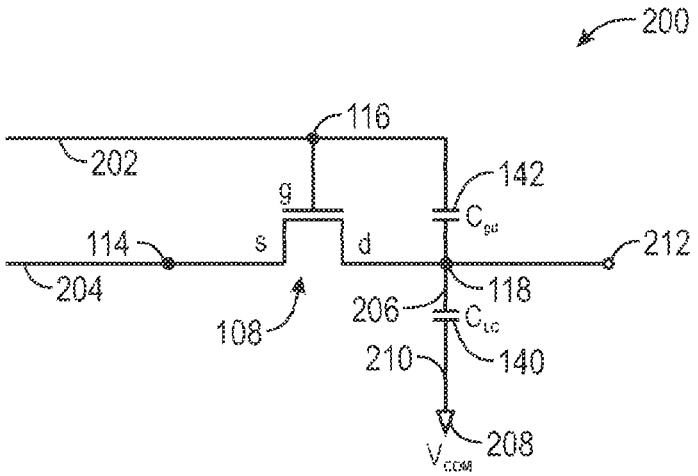
FIG. 8 is a circuit diagram of a dummy pixel of an LCD that can be used to identify kickback voltage, in accordance with an embodiment.
Figure 9:
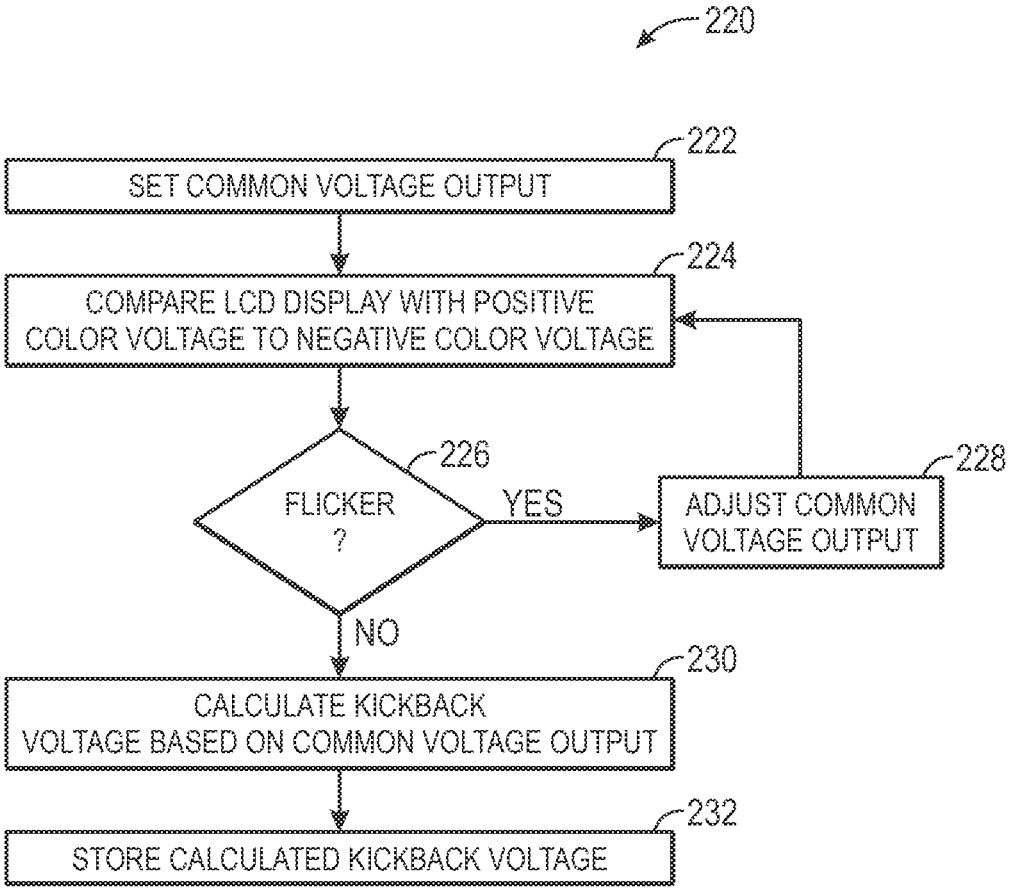
FIG. 9 is a flowchart describing a method for determining the amount of kickback that is expected to occur in pixels of an LCD, in accordance with an embodiment.

As previously described, there may be a variety of ways that the display control circuitry 20 may determine an amount of kickback voltage that is expected to occur in pixels 102 of the display 18 during shutdown of the display 18. Specifically, FIGS. 8 and 9 illustrate a few examples of how the kickback voltage may be determined. For example, in the illustrated embodiment of FIG. 8, the amount of kickback voltage that is expected to occur in pixels 102 of the display 18 may be determined using one or more dummy pixels. In particular, a dummy pixel 200 includes the TFT 108 as previously described. The dummy pixel 200 may be one of many dummy pixels used to determine the amount of kickback voltage expected to occur in pixels 102 of the display 18. Further, the dummy pixel 200 may be located within the electronic device 10 so that the dummy pixel 200 is not on an active portion of the display 18 (e.g., the dummy pixel 200 may not be visible to a user that looks at the display 18 of the electronic device 10). For example, the dummy pixel 200 may be located on a peripheral portion of the display 18 (e.g., near the source driver 120 circuitry) that is concealed, for example, by a black mask material or the enclosure of the electronic device 10.

The gate 116 of the TFT 108 is electrically connected to an activation input line 202 and the source 114 of the TFT 108 is electrically connected to a data input line 204. Further, the drain 118 of the TFT 108 is electrically connected to a pixel electrode 206. A Vcom source 208 is electrically connected to a common electrode 210. A data output sense line 212 is electrically connected to the drain 118 of the TFT 108 to measure an output data signal that represents the voltage difference between the pixel electrode 206 and the common electrode 210. As discussed previously in relation to FIG. 5, liquid crystal capacitance ($C_{LC}$) 140 may be present between the pixel electrode 206 and the common electrode 210 and parasitic capacitance ($C_{gd}$) 142 may be present between the gate 116 and the drain 118 of the TFT 108.

During operation, a Vcom output is supplied by the Vcom source 208. It may be appreciated that, in certain embodiments, the Vcom source 208 may or may not be the same as the Vcom source 128 used supplying the Vcom output for the pixels 102. An activation signal is supplied to the activation input 202 to activate the gate 116 of the TFT 108. In addition, an input data signal is supplied to the data input line 204 and, therefore, to the source 114 of the TFT 108. With the TFT 108 activated, the input data signal supplied to the source 114 flows through the TFT 108 to the drain 118. Thus, the input data signal is supplied to the pixel electrode 206. To store the input data signal in the pixel electrode 206, the activation signal is removed from the activation input 202 while the input data signal is still being supplied to the data input line 204. After the activation signal is removed, the output data signal at the data output sense line 212 is measured to determine the voltage that is stored in the pixel electrode 206. The determined "kickback voltage" is the amount of voltage change by the pixel electrode 206 after the activation signal is removed. As may be appreciated, the amount of voltage change by the pixel electrode 206 may be calculated by finding the difference between the input data signal and the output data signal. Thereafter, the determined kickback voltage may be used, as previously described, for turning off an electronic display so the effects of a kickback voltage in pixels 102 is reduced. In certain embodiments, the output data signal may be the determined kickback voltage and, therefore, a calculation may not be needed to determine the kickback voltage. For example, if the input data signal is a low voltage (e.g., ground or vblack), the output data signal may be the determined kickback voltage.

The amount of kickback voltage that is expected to occur in pixels 102 of the display 18 may also be determined by comparing visible changes in the display 18 when the Vcom output is adjusted, as may be performed during display 18 manufacture to "tune" the display 18 for flicker. FIG. 9 illustrates one example of a method 220 for determining the amount of kickback voltage that is expected to occur in pixels 102 of the display 18. At block 222, the Vcom output from the Vcom source 128 is set to a beginning voltage. For example, in certain embodiments, the Vcom output may be initially set to substantially zero volts. However, the Vcom output may be set to any suitable starting voltage. The Vcom output is supplied to one or more of the common electrodes 112 of the pixels 102.

The display 18 then may be "tuned" to reduce flicker. At block 224, the display 18 may alternate between frames of a color produced by a positive data voltage and frames of the color produced by a negative data voltage. In other words, the display 18 may alternate between storing the positive data voltage associated with the color in the pixel electrodes 110 and storing the negative data voltage associated with the color in the pixel electrodes 110. If the resulting kickback voltage causes the positive and negative voltages to have a slightly different magnitude from Vcom output, the positive and negative voltages may respectively produce slightly different colors. Alternating between these colors may cause the display 18 to appear to flicker. To account for the effect of kickback voltage, the Vcom output may be adjusted up or down.

At decision block 226, a determination is made as to whether flicker is present or substantially absent, based at least partly on observations of the display 18. If flicker is present, at block 228, the Vcom output is adjusted from the beginning voltage to a new voltage. At the new voltage, blocks 224 and 226 are repeated to determine whether flicker is still present. If flicker is still present, the Vcom output is adjusted again. As may be appreciated, blocks 228, 224, and 226 may continue to repeat until flicker is determined to be substantially absent. The Vcom output may be adjusted up or down through blocks 228, 224, and 226 depending on whether display 18 flicker appears to be getting worse or improving.

If flicker is substantially absent, at block 230, the Vcom output is left in place. The amount of kickback voltage may be calculated based on the setting of the Vcom output. Specifically, it may be recalled that the kickback voltage relates to the difference between the positive and negative data voltages of the color on the pixel electrodes 110 depending on the Vcom. Accordingly, the kickback voltage will relate to the Vcom voltage that will cause flicker to become substantially absent. At block 232, the calculated kickback voltage may be stored (e.g., on the storage device 130) for use during shutdown of the display 18. Thereafter, the determined kickback voltage may be used, as previously described, for turning off an electronic display so the effects of a kickback voltage in pixels 102 is reduced.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. A method for reducing the effect of kickback voltage when turning off an electronic display comprising:

determining an amount of kickback voltage that is expected to occur in pixels of the electronic display during shutdown of the display;

supplying a common voltage output to a common electrode of a pixel of the electronic display;

supplying an activation signal to the pixel to activate the pixel;

supplying a data signal to a pixel electrode of the pixel during a period in which the activation signal is being supplied to the pixel, wherein the data signal is substantially equal to the sum of the common voltage output being supplied to the common electrode and the determined kickback voltage; and removing the activation signal from the pixel during a period in which the data signal is being supplied to the pixel to store the data signal in the pixel to reduce the effect of kickback voltage on the pixel electrode of the pixel during shutdown of the electronic display.

2. The method of claim 1, wherein determining the amount of kickback voltage that is expected to occur in pixels of the electronic display comprises obtaining the amount of kickback voltage from a storage device.

3. The method of claim 1, wherein determining the amount of kickback voltage that is expected to occur in pixels of the electronic display during shutdown of the display comprises measuring a kickback voltage of a dummy pixel.

4. The method of claim 1, wherein the common voltage output is ground and the data signal is substantially equal to the determined kickback voltage.

5. The method of claim 1, wherein removing the activation signal from the pixel during the period in which the data signal is being supplied causes the pixel electrode voltage to be substantially equal to the common voltage output.

6. An electronic display comprising:

a plurality of pixels, each pixel having a common electrode and a pixel electrode;

a common voltage source configured to supply a common voltage output to the common electrodes of the pixels;

a gate driver configured to supply activation signals to the pixels to activate the pixels;

a source driver configured to supply data signals to the pixel electrodes when the pixels are activated; and display control circuitry configured to determine an amount of kickback voltage that is expected to occur in pixels of the electronic display during shutdown of the display;

wherein, when the display is to be turned off, the display control circuitry is configured to determine the amount of kickback voltage that is expected to occur in pixels of the electronic display during shutdown of the display, the common voltage source is configured to supply the common voltage output to the common electrodes of the pixels, the gate driver is configured to supply the activation signal to the pixels to activate the pixels, the source driver is configured to supply data signals that are substantially equal to the sum of the common voltage output supplied to the common electrode and the determined kickback voltage, and the gate driver is configured to remove the activation signals from the pixels while the data signals are being supplied to the pixels to store the data signals in the pixels.

7. The electronic display of claim 6, wherein the display control circuitry is configured to determine an amount of kickback voltage that is expected to occur in pixels of the electronic display during shutdown of the display by measuring a kickback voltage of a dummy pixel, or by varying the common voltage output of the electronic display until screen artifacts are reduced, or both.

8. The electronic display of claim 6, wherein removing the activation signal from the pixel while the data signal is being supplied causes the pixel electrode voltage to be substantially equal to the common voltage output.

9. An electronic device comprising:

an electronic display configured, when the electronic display is to be turned off, to supply data signals to pixels and remove activation signals from the pixels while the data signals are being supplied to the pixels to store the data signals in the pixels, wherein the data signals are substantially equal to the sum of a common voltage output to a common electrode of the pixels and a determined kickback voltage; and data processing circuitry configured to control the electronic display by determining when the electronic display is to be turned off and determining the amount of kickback voltage.

10. The electronic device of claim 9, wherein the determined kickback voltage is the amount of kickback voltage that is expected to occur in pixels of the electronic display during shutdown of the display.

11. The electronic device of claim 9, comprising a dummy pixel not on an active portion of the display.

12. The electronic device of claim 11, wherein the dummy pixel comprises an activation input line, a data input line, and a data output sense line.

13. The electronic device of claim 12, wherein the data processing circuitry is configured to determine the amount of kickback voltage by applying an activation signal to the activation input line, applying an input data signal to the data input line, removing the activation signal from the activation input line, measuring an output data signal at the data output sense line, and calculating the difference between the input data signal and the output data signal.

14. The electronic device of claim 9, wherein the data processing circuitry is configured to determine the amount of kickback voltage by varying the common voltage output of the electronic display until screen flicker is reduced.

15. The electronic device of claim 9, wherein the electronic display is configured so that after the activation signals are removed, the pixel electrodes store a voltage substantially equal to the common voltage output.

16. Non-transitory machine-readable media having instructions encoded thereon for execution by a processor, the instructions comprising:

instructions configured to determine when to shut down an electronic display;

instructions configured to determine an amount of kickback voltage that is expected to occur in pixels of the electronic display during shutdown of the display; and instructions configured to cause, when the display is to be shut down, a common voltage output to be supplied to common electrodes of a plurality of pixels of the electronic display, activation signals to be supplied to the pixels to activate the pixels, data signals to be supplied to pixel electrodes of the pixels, and the activation signals to be removed from the pixels while the data signals are being supplied to the pixels to store the data signals in the pixels, wherein the data signals are substantially equal to the sum of the common voltage output to the common electrodes and the determined kickback voltage.

17. A method comprising:

determining an amount of kickback voltage that is expected to occur in pixels of an electronic display during shutdown of the display;

turning off a first line of pixels by:

supplying a common voltage output to a common electrode of the first line of pixels of the electronic display;

supplying a first activation signal to a first gate line to activate the first line of pixels;

supplying data signals to pixel electrodes of the first line of pixels; and removing the first activation signal from the first gate line while the data signals are being supplied to the pixels to store the data signals in the first line of pixels, wherein the data signals are substantially equal to the sum of the common voltage output to the common electrode and the determined kickback voltage; and turning off a second line of pixels by:

supplying the common voltage output to the common electrode of the second line of pixels of the electronic display;

supplying a second activation signal to a second gate line to activate the second line of pixels;

supplying data signals to pixel electrodes of the second line of pixels; and removing the second activation signal from the second gate line while the data signals are being supplied to the pixels to store the data signals in the second line of pixels, wherein the data signals are substantially equal to the sum of the common voltage output to the common electrode and the determined kickback voltage.

18. The method of claim 17, wherein turning off the first line of pixels occurs prior to turning off the second line of pixels.

19. The method of claim 17, wherein turning off the first line of pixels occurs at substantially the same time as turning off the second line of pixels.

20. The method of claim 17, comprising turning off the first line of pixels, the second line of pixels, and all other lines of pixels of the electronic display at substantially the same time.

21. The method of claim 17, wherein the common voltage output is ground and the data signals are substantially equal to the determined kickback voltage.

* * * * *